United States Patent [19]

Klygis

[11] Patent Number: 4,465,180

[45] Date of Patent: Aug. 14, 1984

[54] MULTI-PACKAGE AND MULTI-PACKAGING DEVICE

[75] Inventor: M. Julius Klygis, Barrington, Ill.

[73] Assignee: Illinois Tool Works Inc., Chicago, Ill.

[21] Appl. No.: 403,172

[22] Filed: Jul. 29, 1982

[51] Int. Cl.[3] ..... B65D 85/62

[52] U.S. Cl. ..... 206/158; 206/151; 206/199; 294/87.2

[58] Field of Search ..... 206/141, 142, 143, 145, 206/146, 147, 148, 150, 151, 152, 153, 155, 156, 158, 168, 194, 199, 427, 430, 431, 432, 435, 628; 220/23.2, 23.4, 23.83, 23.86; 294/87.2

[56] References Cited

U.S. PATENT DOCUMENTS

| | | | |
|---|---|---|---|
| 3,432,029 | 3/1969 | Brown | 294/87.2 |
| 3,721,337 | 3/1973 | Braun et al. | 206/150 |
| 4,109,787 | 8/1978 | Klygis et al. | 206/150 |
| 4,190,149 | 2/1980 | Oliff et al. | 206/145 |
| 4,304,329 | 12/1981 | Graser | 206/148 |
| 4,305,499 | 12/1981 | Mercer | 206/150 |

FOREIGN PATENT DOCUMENTS

| | | | |
|---|---|---|---|
| 1401892 | 8/1975 | United Kingdom | 206/628 |

*Primary Examiner*—William T. Dixson, Jr.
*Assistant Examiner*—Jimmy G. Foster
*Attorney, Agent, or Firm*—Thomas Buckman

[57] ABSTRACT

A multi-packaging device for creating a package designed particularly for an array of bottle-like containers. A relatively flat sheet member is configured so that upon association of the sheet members with the array so that as the necks of each bottle are forced through slits in the device, the device is stressed and resiliently deformed to create end, side, and central panel portions that conform to the shoulders and necks of the bottles, thus creating a highly unitized and stable package.

11 Claims, 6 Drawing Figures

MULTI-PACKAGE AND MULTI-PACKAGING DEVICE

BACKGROUND AND SUMMARY OF THE INVENTION

This invention relates to sheet plastic devices for creating packages of a plurality of containers. More particularly, the invention relates to a flat sheet-like thermoplastic device for creating a highly unitized and stable package for bottle-like containers.

Integral sheet-like devices for multi-packaging can-like containers are widely accepted, and have been found to be an efficient and very effective means for handling such containers. However, the multi-packaging of bottle-like containers creates problems which have not been so effectively solved.

A variety of different packaging techniques have heretofore been utilized in an attempt to multi-package bottle-like containers, which are generally defined as including a cylindrical body portion, reduced neck portion, and shoulder portion interconnecting the body and the neck. For example, complete wrap-around paperboard is a typical manner of creating such a multi-package. The large amount of material used and susceptibility of this package to moisture indicates that better approaches should be available.

Various types and combinations of carriers and package making devices which involve integrating an array of containers by a top-gripping device as generally typified in U.S. Pat. No. 3,876,066 are known in the prior art. Such top-gripping devices permit the body portions of the bottle to move relative to one another, which, in the case of glass bottles, could be dangerous, and in general, create an unstable package.

There are also various combinations of top grip and array confining bands, as typified, for example, in U.S. Pat. No. 3,653,504. While such a package may create a substantially unitized array, the assembly techniques and difficulties of removal of the bottles from the package are deficiencies in this type of package.

A single element device formed as an inverted tray-like member with apertures in the flat base portion and downwardly depending skirt walls, as typified in U.S. Pat. No. 4,139,094, are available, but bottles are relatively difficult to remove from such a package, and, furthermore, the thermoforming operation is a relatively complex precedure.

With the above as background of the milti-packaging design concepts available for bottles, the advantages and objects of this invention will be listed.

It is a primary object of this invention to provide a multi-package for bottles which is highly unitized and minimizes the relative movement of each bottle in the array to one another.

Another object of the invention is to provide a planar, sheet-like thermoplastic device which not only integrates an array into a package, but is designed to resiliently engage the neck and/or shoulder portions of each body to unitize the array.

A further object of the invention is to provide a planar, sheet-like packaging device which is relatively easy to apply to an array of containers, and is designed so that each container can be readily removed from the array.

A further object of the invention is to provide a novel manner of creating a multi-package from a sheet-like device which transforms such a device into a highly stressed thermoplastic unitizing member.

The carrier device and multi-package described here herein is typified by a plurality of pairs of slit means created in the sheet-like thermoplastic member. The plurality of pairs of slits are designed to intersect in such a manner as to create a very restricted opening in the sheet when the sheet is in an unstressed position. The intersections of the slits are further arranged to be aligned with the longitudinal axis of bottles when the bottles are arranged in a closely contacting array. Furthermore, the restricted opening created by the slits is significantly less than the diameter of the neck of each bottle so that as the neck of the bottle is forced through the slits, the regions of the sheet adjacent the slits are stressingly deformed upwardly, out of the plane of the sheet. The sheet, being of a relatively stiff thermoplastic material, is furthermore designed so that the remaining portions of the sheet, that are not deformed upwardly, are stressingly deformed downwardly to attempt to follow the plane or repositionment of the regions of the sheet adjacent to slits. This stressing deformation thus creates a pair of opposing end panels which are deformed downwardly, a pair of opposing side panels which are also deformed downwardly, and central panel portions which are deformed in a U-shaped manner between rows of containers.

The resulting package created by the sheet member thus is a highly unitized package as a result of the stress in the device and the closely conforming contact between the device and the bottles.

Primary embodiment and alternate embodiments of the invention show a variety of weakening means in the panels designed for selective removal of each bottle from the array.

DETAILED DESCRIPTION OF THE PREFERRED EMBODIMENTS

Figure 1:
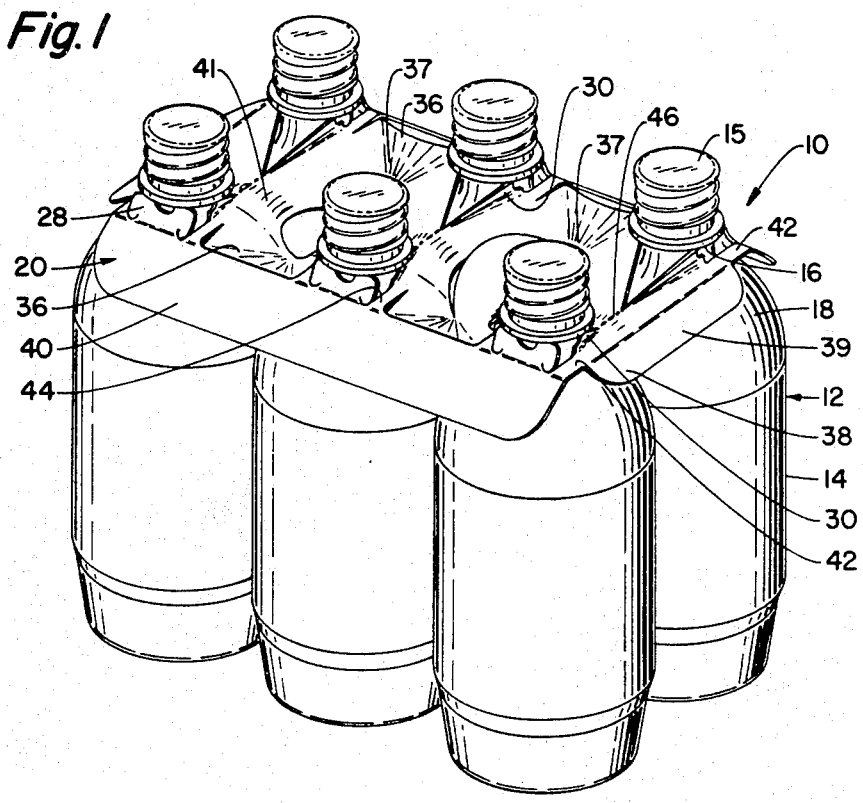
FIG. 1 is an isometric view of the package of the invention.
Figure 2:
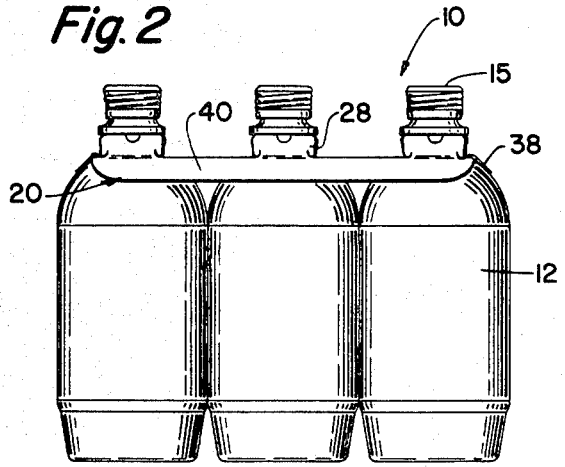
FIG. 2 is a side elevational view of the package of the invention.
Figure 3:
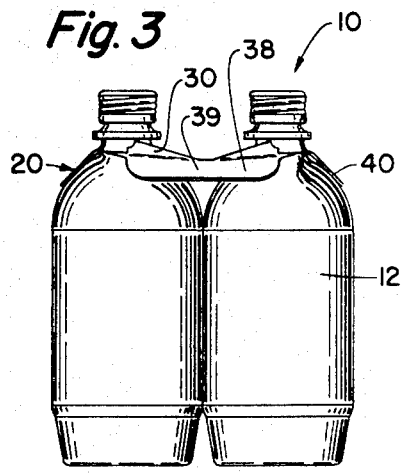
FIG. 3 is an end elevational view of the package of the invention.

Referring now in greater particularity to the drawings, and first referring to FIGS. 1, 2, and 3, it will be shown that the multi-package 10 includes a plurality of bottle-like containers 12 being secured and otherwise unitized together by thermoplastic device 20. The bottles may typically be described as including an enlarged generally cylindrical body section 14 and having a reduced diameter neck section 16 terminating in a cap 15. A shoulder region 18 joins the enlarged body portion 14 with the neck region 16.

It should be understood that a variety of different configurations of bottles meeting this general description are available and will be available. Furthermore, it should be understood that these bottles may be either glass, plastic, metal, or a composite of various materials.

As noted above, however, typical of the problems that ensue when one attempts to multi-package containers of the above general description is the tendency of the body regions to splay or move relative to one another due to the reduced neck portion. Thus, it is difficult and has been difficult to obtain a package which is unitized. For purposes of this specfication the word "unitized" is intended to mean a structure that is made up of a plurality of discrete parts that is assembled or packaged together so that relative movement of one another is minimized and so that the package is handled as a compact unit rather than a plurality of items merely arrayed together or joined together.

Figure 4:
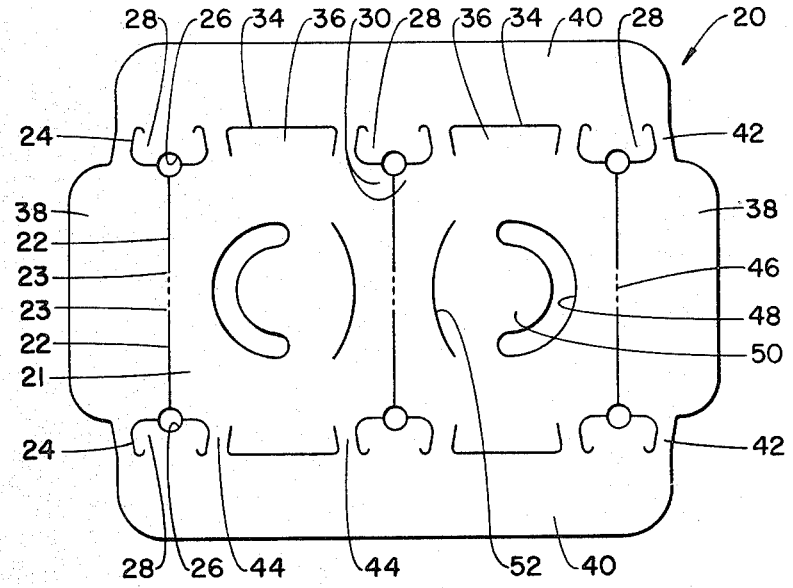
FIG. 4 is a top plan view of a preferred embodiment of the device of this invention.

Turning now to FIG. 4, with reference still to FIGS. 1–3, the device 20 will be described in more detail as it relates to the specifics which create the novel package. The device as may be shown in FIG. 4 may be described as being generally rectangular, although the exact outer peripheral configuration is not critical to the invention. The outer peripheral dimension should be not substantially greater, nor substantially less than, the peripheral dimension created by the array of bottles to be packaged. The array should typically be a plurality of bottles arranged in ranks and rows, with the bottles preferably in contacting, or very closely spaced, relationship to one another.

Positioned within the outer periphery of the device 20 are a plurality of slits. First slit means 22 may be defined as extending generally laterally of the device, and the second slit means 24 may be described as extending generally longitudinally of the device. The terms "lateral" and "longitudinal" are arbitrarily used to locate the slit means, and will generally correspond respectively to the rank and row directions of the package or the array. It is important to note that the innermost extremity 23 of each of the lateral slits are spaced from one another, in other words the slits are not continuous. The number of slits 22 and 24 in each device will correspond to the number of containers in the array.

The slit means 24, which primarily extend longitudinally, are preferably C-shaped in actual configuration, with the extremities of each slit 24 facing toward the outer periphery of the sheet so that the intermediate regions of slits 24 and slits 22 will intersect at junction region 26. For purposes to be described later herein, the point of intersection may involve total removal of a small amount of material forming either a circle or a tear shaped aperture.

Referring further to FIG. 4, it will be shown that a third series of slits 34 are formed in the device, again interiorly of the periphery of such a device. These third slits 34 are shown to extend generally longitudinal of the device generally aligned with slits 24. These third slits 34 are similar to slits 24 in that they also are preferably C-shaped in configuration; however, slits 24 and 34 differ in that the extremities of the C-shaped slits 34 extend toward the central portions of the device rather than toward the outer periphery. It should be clear from viewing the drawing in FIG. 4 that the slitting of the sheet by slit means 24 and 34 create discrete tabs or flaps. Tabs 28 are thus formed by the C-shaped slits 24, and tabs 36 are formed by C-shaped slit means 34. Tabs 36 are thus interposed between, and are aligned longitudinally with, adjacent tabs 24.

It is appropriate to further define the sheet surface regions directly adjacent the lateral slit means 22 as flaps 30. These flaps, as will be shown later herein, operate in conjunction with tabs 24 to receive the necks of the bottles and retain the bottles in the package.

It is important to note that the plurality of openings created in the sheet 20, as a result of the intersection of slits 24 and 22 at point 26 are, when the sheet is in an unstressed condition, very small and restricted. The diameters of the necks 16 of the bottles is significantly greater than the restricted opening created at the intersection point 26. Thus, it should also be clear that the dimension $D_1$ between longitudinal adjacent pairs of lateral slits 22 is greater than the dimension $D_2$ between neck surfaces in longitudinal adjacent ranks of bottles as shown, for example, in FIG. 2.

With the unstressed structure of the device 20 and stressed finished package 10 both in mind, it is important to describe the method in which the device is associated with the array of bottles. The device is first positioned above the array with the longitudinal center line of each bottle generally registering with the intersection region 26 of an associated pair of slits 22 and 24. With this relationship established, some means of moving and holding the device downwardly relative to the array is accomplished. It should be understood that for purposes of this invention that the array could be moved upwardly relative to the device, just as the device could be moved downwardly relative to the array. As the caps 15 contact the undersurface of the device and are forced through the intersection points 26, the entire device 20 is stressed. This stressing is first accomplished by the movement or pivoting upwardly of the plurality of tabs 28 and flaps 30. The reaction force of the pivoting of these flap and tab regions is transmitted to the remaining surface regions of the device 20 creating stress in these remaining surfaces. In the outer peripheral regions of the device, the stressing of the relatively rigid, but thin, plastic sheet causes regions defined as end panels 38 and side panels 40 to deflect downwardly respectively to the upward stressing deflection of flaps 30 and tabs 28. This responsive stressing or conformation is made possible by web means 42, which interconnect the end and side panels 38 and 40, and hinge means 44, which essentially are located between longitudinal disposed tabs 28 and 36.

With reference to FIGS. 1–3, it will be shown that the existence and location of slit 34 and resulting tab 36 form an important part in usefully transmitting the stresses to create a unitized package. The web means 42 and hinge means 44, being of limited width, permit the side panels and end panels to be forced downwardly as a result of the stressing deformation of the tabs 28 without hindrance to such free movement by the remaining portions of the device. For example, if the central panel region 21 were completely connected to the end panels, this novel use of the stresses would not accomplish the purposes of the invention.

Furthermore, the existence of the tab 36 permits the flaps 30 to stressfully deform the central panel portion 21 so that generally U-shaped troughs 37 are formed between ranks of bottles in the array.

The use of high density, rigid polyethylene has been found to be advantageous as a material for the device in conjuction with the structure described herein. It should be understood, however, that other materials may be used if they are of sufficient density/thickness to produce the stresses required for a suitable package.

Av overview of the package thus created shows that a resilient and stressful contact between the side panels 40 and shoulder and neck regions of the bottles tends to resiliently force the rows inwardly toward one another into bottle to bottle contact.

Furthermore, the end panels 38 tend to contact and resiliently force the ranks toward one another into bottle to bottle contact. It should be further noted that a generally U-shaped trough configuration 39 is formed at the end panels that tend to increase the bottle contact between these resilient panels and, in fact, further enhance the resistance to move-ment between bottles. A similar U-shaped configuration 41 is found in the shoulder regions of the central panel portions, thus a carefully controlled and stressed resilient contact between the central panel portions and significant surface of the neck and shoulder regions contribute to the high unitization of the package.

To facilitate the handling of such a package, a finger hole means 48 may be created, which as shown in the drawings, is generally C-shaped. A tab means 50 may be associated with the hole to facilitate the comfortable handling of the package, and a relief slot 52 may further be included to provide the proper relief for use of this slot while not harming the careful use of the stresses of the center panel that are desired for the package.

Different configurations of apertures 26 at the intersection of slits 24 and 22 may provide different amounts of line contact with the regions beneath the caps of the bottles to further stabilize the package.

It should be further noted that the preferred embodiment of the configuration of the slits 34 and 24 are such that they create diagonal lines leading to the hinge point of the tabs. This improves the wrap-around aspects of the invention, and thus further enhances the stability of the package.

Removal of bottle from such a highly unitized package is, of course, critical to the total function of such package. With this in mind, there are several alternate ways of effectively removing such containers. A first, and preferred, manner is the use of weakening or perforated lines in the device. For example, a series of perforated or weakening lines 46 can be provided to merge with the innermost extremities 23 of the lateral slits 22. This is shown in FIG. 4, and in operation, the bottles may be individually tilted outwardly of the array, creating stresses in the centermost regions, causing the perforations 46 to rupture. The rupture of the regions 46 create an unstressed, large aperture between opposing tabs 28, thus permitting easy manipulation of the device and/or bottles to remove bottles in that particular rank. Of course, each successive rank may be manipulated to rupture the appropriate perforation means 46.

Figure 5:
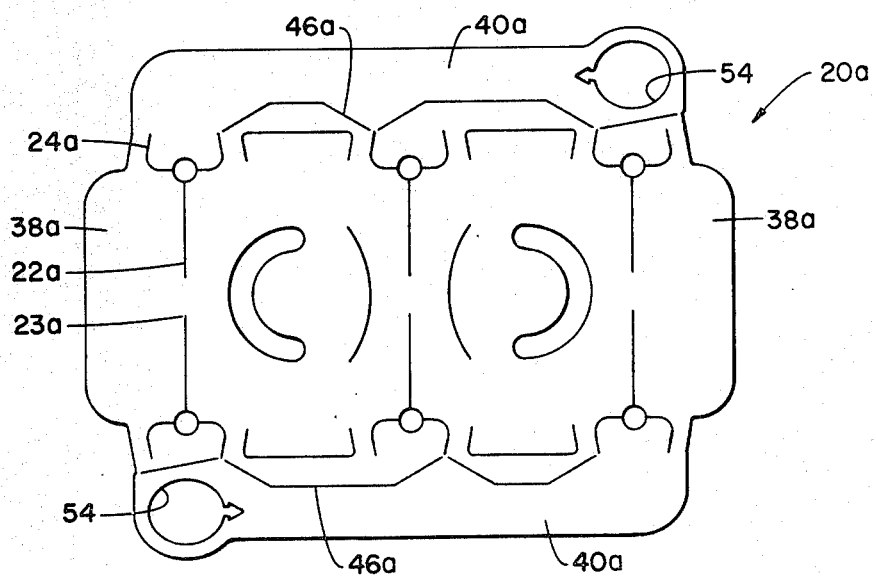
FIG. 5 is a top plan view of an alternate embodiment of the device in accordance with this invention.

A further manner of producing the opening of such a device is to create a pattern of perforation on the side panels, such as a line of perforations **46*a* shown in FIG. 5 in each side panel 40*a*. The package may be selectively opened by use of the finger hole apertures 54 in each side panel and pulling that extremity of the side panel upwardly towards the opposing extremity of the side panel in the package. This creates selective intersection of successive longitudinal slit means 24*a***, which, of course, will increase the aperture holding the bottles and unstress the package at that region.

Obviously the opposing row of bottles can be removed by identical manipulation of the opposing side panel **40*a***.

Figure 6:
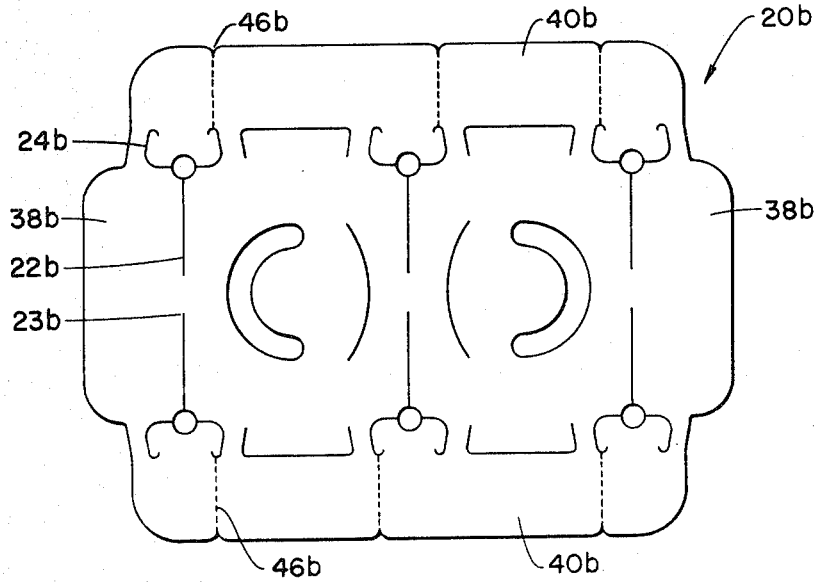
FIG. 6 is a top plan view of a further alternate embodiment of the device in accordance with this invention.

A further alternate manner is shown in FIG. 6, which incorportates perforation or weakened means **46*b* in each side panel 40*a* extending generally laterally of the panel into intersection with the slit means 22*b*. These individual side panel segments can be manipulated by rupturing the perforation means 46*b*** upwardly to the intersection of the bottle-gripping aperture to greatly enlarge and to remove the bottles.

It is thus clear that the packing device described above creates a novel technique and manner of creating a highly unitized package, primarily through the use of stressing of selected regions of the device and permitting this stress to be freely carried throughout the remaining portions of the device. Furthermore, through the use of what may be described as a "column" effect of a series of tabs and flaps, which abut against a protuberance chime, or undersurface of a cap adjacent the top of the bottles.

Having described the invention it is to be understood that changes can be made in the described embodiments within the spirit and scope of the invention as described by the appended claims.

I claim:

1. A multi-packaging device for bottle-like containers which generally incorporate a body portion, reduced neck portion and shoulder portion interconnecting the neck and body portions, the device comprising a sheet of resilient, deformable plastic material, a plurality of pairs of first slits formed in a central panel region of the sheet, each first slit creating an opposing pair of flap means directly adjacent said first slit on either side thereof, the pairs of first slits extending laterally of the sheet with the slits of each pair being laterally aligned but discontinuous relative to each other and each slit defining an outermost extremity and innermost extremity, each pair of pairs being longitudinally spaced from each other a predetermined distance, a series of second slit means extending generally longitudinal of the sheet and each second slit defining a first tab mean, each outermost extremity of each first slit intersects a second slit means, each first tab means and flap means being designed to pivot upwardly from the plane of the sheet to grip the neck portion of a bottle, a plurality of second tab means formed by third slit means in said sheet, each second tab means positioned intermediate a pair of longitudinally adjacent first tab means with the first and second tab means on a given side of the longitudinal center line of the sheet being generally longitudinally aligned, the perimeter of the device defined by a pair of opposing end panels and pair of opposing side panels interconnected by web means which permit said panels to be downwardly deflected as the first tab means and flap means are deflected upwardly to resiliently conform to the necks of the bottles, the first slits and second slits arranged to intersect and form a resilient bottle neck grasping region while the third slits permit tab means of flap means to deflect into conforming contact with the bottles, the bend line of the first tab means, the third slot means and the bend line of the side panels being generally aligned.

2. The multi-packaging device of claim 1 wherein the side panels are connected to the central panel region by narrow hinge means intermediate said first and second tab means on each side of the device to facilitate the downward resilient deflection of the side panels.

3. The multi-packaging device of claim 1 wherein the central panel portion includes handle means formed therein.

4. The multi-packaging device of claim 3 wherein the handle means are a pair of longitudinal spaced slots with deformable finger contacting tabs extending therein.

5. The multi-packaging device of claim 1 including perforation means interconnecting adjacent slit means to facilitate selective removal of each bottle packaged by said device.

6. The multi-packaging device of claim 5 wherein the perforation means interconnects the innermost extremities of each pair of laterally aligned first slits.

7. The multi-packaging device of claim 5 wherein the perforation means extends generally longitudinally in each side panel intersecting each of the second slit means adjacent each side panel.

8. A multi-package of closely spaced bottle-like containers, including a plurality of containers each configured to include a body portion, a reduced neck portion and shoulder region interconnecting the body and neck portions, the plurality of containers arranged in an array of a plurality of ranks and rows, the package including a relatively rigid thermoplastic sheet unitizing device embracing the neck portions of each bottle, the device including parts of slit means equal in numbers to the number of containers in the array, each pair including a first slit extending generally laterally of the device in the direction of the ranks of containers and a second slit extending generally longitudinally in the direction of the rows of containers, the pair of slits creating three interacting flap means which pivot upwardly from the plane of the sheet device when the necks of the containers are inserted there through, the device further including hinge means of limited width associated with each flap means permitting predetermined surface areas of the sheet adjacent each flap means to be pivoted downwardly from the plane of the sheet so that the flap means and adjacent predetermined surfaces are forced into resilient surface engagement with regions of the neck and shoulders of each bottle to tightly unitize the package, wherein the regions of the sheet device intermediate ranks of containers are generally U-shaped in cross section defining a trough-like section extending generally parallel to the ranks of containers.

9. The multi-package of claim 8 wherein the perimeter surface regions of the device are parts of said predetermined surface areas adjacent said flap means opposing pairs of end panels and side panels interconnected by web means, said panels being deformed downwardly into array confining contact with the shoulder and neck regions of the bottles.

10. The multi-package of claim 8 including weakened means in the device associated with at least one of slits in each pairs of slits designed to increase the size of each neck receiving aperture responsive to tilting of each bottle to facilitate removal of each bottle.

11. The multi-package of claim 9 wherein the end panels are further resiliently deformed inwardly of the array conforming to the upper surfaces of the bottles in each end rank.

* * * * *